US006769489B2

(12) United States Patent
Dallas

(10) Patent No.: US 6,769,489 B2
(45) Date of Patent: Aug. 3, 2004

(54) WELL STIMULATION TOOL AND METHOD OF USING SAME

(76) Inventor: L. Murray Dallas, 790 River Oaks Dr., Fairview, TX (US) 75069

( * ) Notice: Subject to any disclaimer, the term of this patent is extended or adjusted under 35 U.S.C. 154(b) by 148 days.

(21) Appl. No.: 10/050,024

(22) Filed: Jan. 15, 2002

(65) Prior Publication Data

US 2003/0116314 A1 Jun. 26, 2003

(30) Foreign Application Priority Data

Nov. 29, 2001 (CA) ..... 2364151

(51) Int. Cl.[7] ..... E21B 33/03; E21B 33/038; E21B 33/068; E21B 43/01

(52) U.S. Cl. ..... 166/386; 166/97.1; 166/85.1; 166/360; 166/368

(58) Field of Search ..... 166/368, 360, 166/378, 379, 381, 382, 386, 387, 75.11, 75.13, 77.1, 77.4, 85.1–85.5, 97.1

(56) References Cited

U.S. PATENT DOCUMENTS

| | | | | | |
|---|---|---|---|---|---|
| 4,127,167 | A | * | 11/1978 | Arendt | 166/85.1 |
| 4,241,786 | A | | 12/1980 | Bullen | 166/77 |
| 4,632,183 | A | | 12/1986 | McLeod | 166/77 |
| 4,867,243 | A | * | 9/1989 | Garner et al. | 166/379 |
| 4,940,095 | A | | 7/1990 | Newman | 166/378 |
| 5,012,865 | A | | 5/1991 | McLeod | 166/90 |
| 5,103,900 | A | * | 4/1992 | McLeod et al. | 166/88.1 |
| 5,785,121 | A | | 7/1998 | Dallas | 166/90.1 |
| 5,819,851 | A | | 10/1998 | Dallas | 166/308 |
| 5,927,403 | A | | 7/1999 | Dallas | 166/77.51 |
| 5,967,235 | A | * | 10/1999 | Scott | 166/379 |
| 5,988,274 | A | | 11/1999 | Funk | 166/77.4 |
| 6,009,941 | A | | 1/2000 | Haynes | 166/72 |
| 6,019,175 | A | | 2/2000 | Haynes | 166/382 |
| 6,059,042 | A | * | 5/2000 | Huber et al. | 166/377 |
| 6,145,596 | A | | 11/2000 | Dallas | 166/379 |
| 6,179,053 | B1 | * | 1/2001 | Dallas | 166/77.51 |
| 6,209,633 | B1 | | 4/2001 | Haynes | 166/72 |
| 6,220,363 | B1 | | 4/2001 | Dallas | 166/382 |
| 6,234,253 | B1 | | 5/2001 | Dallas | 166/377 |
| 6,247,537 | B1 | | 6/2001 | Dallas | 166/379 |
| 6,289,993 | B1 | | 9/2001 | Dallas | 166/386 |
| 6,364,024 | B1 | | 4/2002 | Dallas | 166/379 |
| 6,447,021 | B1 | | 9/2002 | Haynes | 285/302 |
| 6,470,965 | B1 | * | 10/2002 | Winzer | 166/77.4 |
| 6,510,900 | B2 | | 1/2003 | Dallas | 166/384 |
| 6,595,297 | B2 | * | 7/2003 | Dallas | 166/382 |
| 2003/0089502 | A1 | * | 5/2003 | Dallas | 166/379 |
| 2003/0111271 | A1 | * | 6/2003 | Dallas | 175/423 |

OTHER PUBLICATIONS

Patent application Ser. No. 09/537,629 entitled "Blowout Preventer Protector and Method of Using Same," filed Mar. 29, 2000.

Patent application Ser. No. 09/791,980 entitled "Method and Apparatus for Inserting a Tubing Hanger Into a Live Well," filed Feb. 23, 2001.

Patent application Ser. No. 09/998,953 entitled "Spool for Pressure Containment Used in Rigless Well Completion, Re–Completion, Servicing or Workover," filed Nov. 15, 2001.

Patent application Ser. No. 10/034,032 entitled "Slip Spool and Method of Using Same," filed Dec. 19, 2001.

* cited by examiner

*Primary Examiner*—David Bagnell
*Assistant Examiner*—Jennifer H Gay
(74) *Attorney, Agent, or Firm*—Nelson Mullins Riley & Scarborough, LLP

(57) ABSTRACT

A well stimulation tool is connected to a top of a tubing hanger in a well to be stimulated. The well stimulation tool includes an adapter pin that connects to the tubing hanger. The adapter pin is connected to a mandrel that reciprocates through a top end of an adapter spool, which is mounted to a tubing head spool that supports the tubing hanger. A high-pressure valve is mounted to a top end of the mandrel. High-pressure fluids are pumped through the high-pressure valve, the mandrel, the adapter pin, the tubing hanger, and a production tubing into the well.

20 Claims, 7 Drawing Sheets

WELL STIMULATION TOOL AND METHOD OF USING SAME

TECHNICAL FIELD

The present application claims priority to Canadian Application No. 2,364,151, filed with the Canadian Intellectual Property Office on Nov. 29, 2001.

The invention relates to the stimulation of oil and gas wells to improve production and, in particular, to a well stimulation tool used to deliver high-pressure fluids through a production tubing of a well in order to acidize and/or fracture subterranean formations with which the well communicates.

BACKGROUND OF THE INVENTION

It is well known that many oil and gas wells require stimulation in order to increase production either as a part of well completion, or as a part of well workover. Well stimulation involves the pumping of fluids under high pressure into the annulus of the well in order to break up subterranean formations and release hydrocarbons into the wellbore, where they can be extracted to the surface. Since it is generally not economically feasible to manufacture wellhead equipment that can withstand extreme pressures, the wellhead must be isolated or removed during well stimulation in order to prevent potential damage and/or injury.

One method of stimulating a well is to pump high-pressure fluids down a production tubing suspended in the well. To accomplish this, the production tubing is plugged and the wellhead is removed from the well. An extension is then screwed into the top of the tubing hanger and high-pressure fluids are pumped through a high-pressure valve that communicates with a top of the extension. A high-pressure adapter of this type is described in U.S. Pat. No. 5,103,900 that issued on Apr. 14, 1992 to McLeod et al., and entitled HIGH PRESSURE ADAPTER FOR WELLHEADS. McLeod et al. describe an improvement to the McEvoy PST adapter and pack-off nipple in which vent ports are added to the McEvoy tubing head adapter to comply with American Petroleum Institute (API) regulations respecting elevations in pressure rating between adjacent adapters.

The McEvoy PST adapter and McLeod et al.'s improvements to it suffer from several disadvantages, however. First, each adapter must be constructed for a specific size of production tubing. Consequently, at least one adapter must be kept in stock for each size of production tubing that is to be serviced. Second, the flow path of high-pressure fluids is interrupted by an internal bore in the tubing head adapter. The internal bore provides a space where eddy currents develop in the high-pressure fluids. The eddy currents tend to cause abrasive well stimulation fluids to "wash out" a top end of a pack-off nipple that connects to the tubing hanger. As is well understood in the art, damage caused by wash out can cause dangerous pressure leaks.

There therefore exists a need for a well stimulation tool that permits high-pressure fluids to be safely pumped down the production tubing of a hydrocarbon well.

SUMMARY OF THE INVENTION

It is therefore an object of the invention to provide a well stimulation tool that permits high-pressure fluids to be safely pumped down the production tubing of a hydrocarbon well.

It is a further object of the invention to provide a well stimulation tool that is quickly and easily mounted to an exposed tubing hanger of a hydrocarbon well.

The invention therefore provides a well stimulation tool for stimulating a well having a tubing head mounted to a casing spool of the well and a production tubing suspended from a tubing hanger in the tubing head. The well stimulation tool comprises an adapter spool having a bottom flange adapted for connection to one of a tubing head and a blowout preventer mounted to the tubing head. The adapter spool has a top end adapted to receive a mandrel that can be reciprocally moved through a packing that surrounds the mandrel and is retained in a packing cavity in the top end of the adapter spool. The top end of the adapter spool further includes threads for securing a lockdown nut that covers the packing and surrounds an outer periphery of the mandrel.

The mandrel includes a mandrel top end having a flange adapted for the connection of a high-pressure valve, and a mandrel bottom end having a thread for the connection of an adapter pin. The adapter pin has a top end with threads for connecting the adapter pin to the mandrel bottom end. The adapter pin also has a bottom end with threads for connecting the adapter pin to the top end of a tubing hanger.

The well stimulation tool preferably further includes a high-pressure flange adapted to be mounted to a top of the high-pressure valve. The high-pressure flange has a pressure flange bottom end adapted for connection to a top flange of the high-pressure valve. The high-pressure flange also has a top end that is threaded for connection to a high-pressure line for injecting high-pressure well stimulation fluids into the well.

In accordance with one embodiment of the invention, The well stimulation tool further comprises a lifting head assembly including a first member and a second member. The first member has a bottom end adapted to be connected to the high-pressure flange. The second member has means for connecting a hoist to the well stimulation tool. When the lifting head assembly is connected to the combination of the high-pressure flange, high-pressure valve, the adapter spool, the mandrel and the adapter pin, and hoisted above the well, the adapter pin extends below the bottom flange of the adapter pin to facilitate the installation of the well stimulation tool to the tubing hanger.

The lifting head assembly includes a hollow cylinder having a lifting head top end and lifting head bottom end. The lifting head bottom end includes an aperture. A lifting sub having a top end, which reciprocates freely within the hollow cylinder but cannot pass through the aperture in the bottom end, is adapted to connect to a top end of the high-pressure flange. A lifting eye is affixed to the lifting head top end.

The lifting head further comprises opposed, radially extending lift arms adjacent the lifting head bottom end, the lift arms respectively including a lift eye located near an outer end thereof. The lockdown nut also comprises opposed, radially extending lift arms respectively including a lift eye located near an outer end thereof. First and second lifting cables interconnect the lift arms of the lift head and the lockdown nut. Consequently, when the well stimulation tool is lifted using the lifting eye affixed to the top end of the lifting head, the lifting sub top end moves downwardly within the hollow cylinder and the lifting cables bear the weight of the lockdown nut and the adapter spool. As a result, the mandrel is stroked down through the adapter spool and the adapter pin is extended beneath the bottom flange of the adapter spool to permit the adapter pin to be connected to, or disconnected from, the top end of the tubing hanger.

The invention further provides methods for completing and stimulating oil and gas wells.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENTS

The invention provides a well stimulation tool that permits high-pressure fluids to be pumped into the well through a production tubing string suspended in the well by a tubing hanger. The tool facilitates a fast, sure connection to the tubing hanger.

Figure 1:
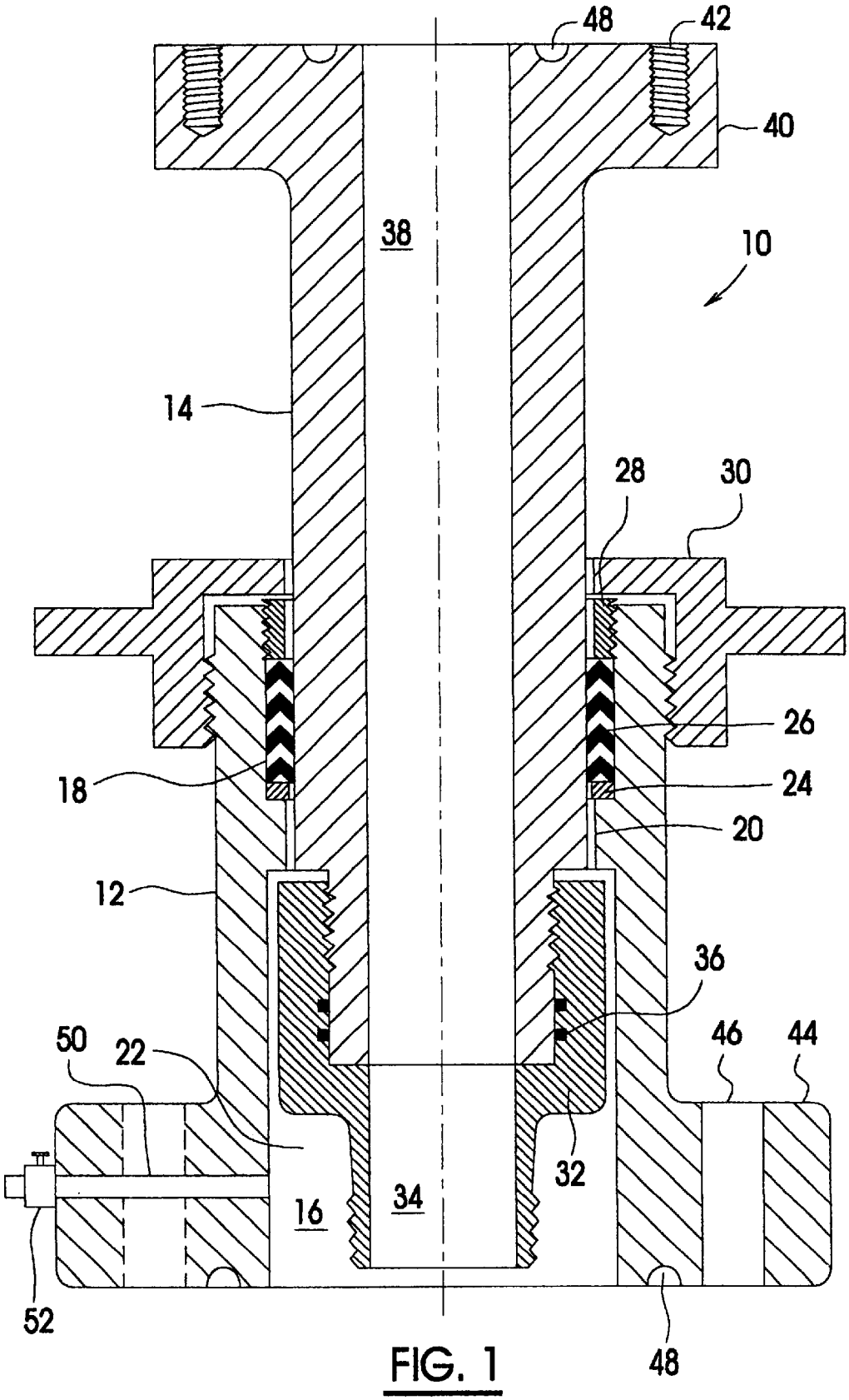
FIG. 1 is a cross-sectional view of a well stimulation tool in accordance with one embodiment of the invention.
Figure 3:
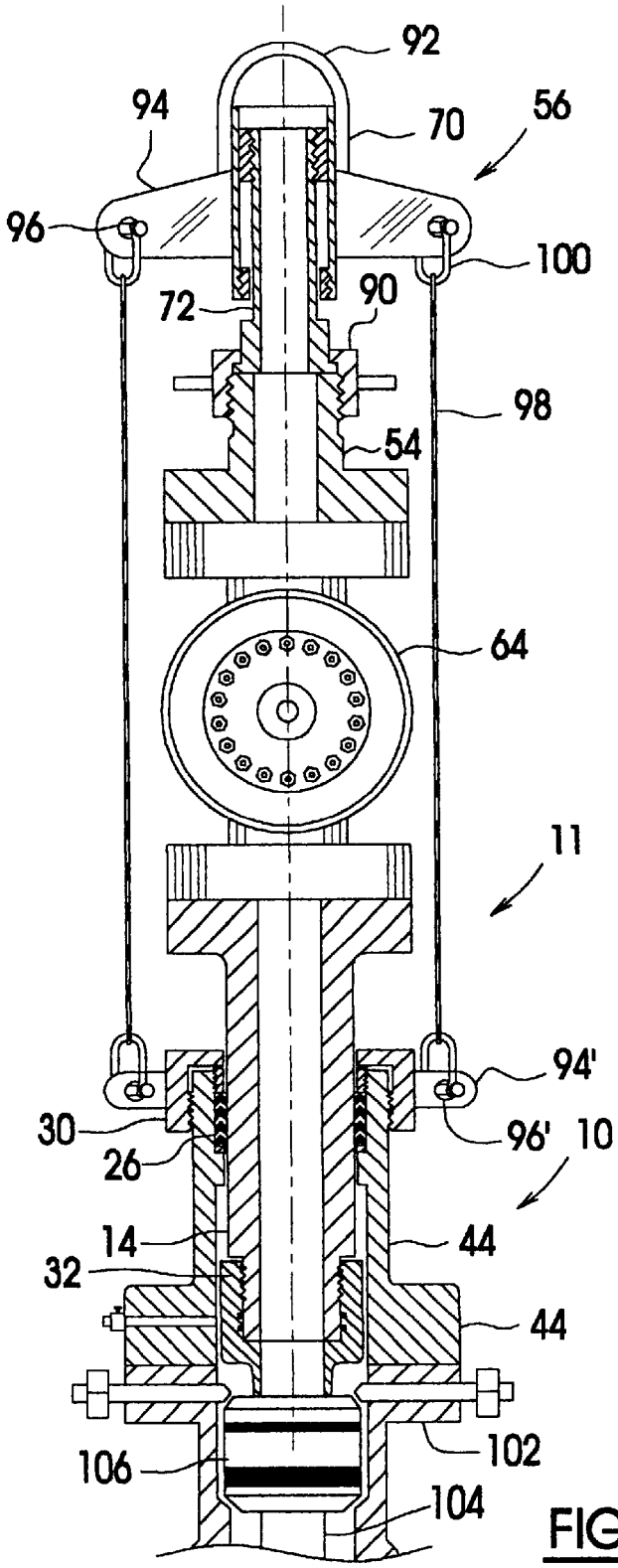
FIG. 3 is a cross-sectional view of the well stimulation tool with the high-pressure valve shown in FIG. 2 installed on the well.
Figure 7:
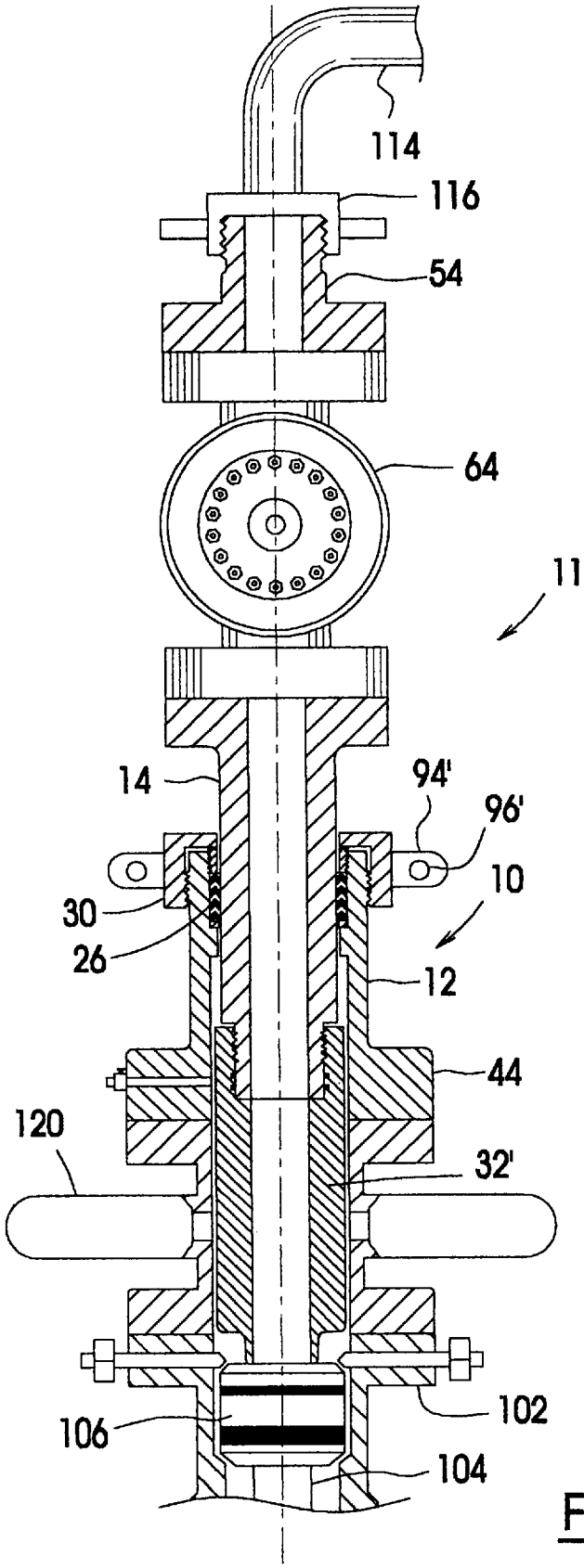
FIG. 7 is a schematic cross-sectional view showing the well stimulation tool shown in FIGS. 2 and 3 with an elongated adapter pin used to stimulate a hydrocarbon well through a blowout preventer.

FIG. 1 is a cross-sectional view of the well stimulation tool in accordance with one embodiment of the invention. The well stimulation tool, generally indicated by reference numeral 10, includes an adapter spool 12. A mandrel 14 is received in an axial passage 16 in the adapter spool 12. The axial passage 16 includes a throat region 20 and an adapter pin docking region 22. The throat 18 retains a steel packing washer 24. High-pressure packing 26, such as a chevron packing, is retained above the steel packing washer 24. The high-pressure packing 26 closely surrounds and provides a high-pressure seal around the mandrel 14, in order to ensure that well fluids do not escape to the atmosphere when the adapter spool 12 is mounted to one of a tubing head spool 102, as shown in FIG. 3, and a blowout preventer 120 mounted to the tubing head spool 102, as shown in FIG. 7. The high-pressure packing 26 is retained by a gland nut 28. A lockdown nut 30 threadedly engages a spiral thread on an outer periphery of the top end of the adapter spool 12. A top wall of the lockdown nut 30 projects inwardly to cover the gland nut 28 in order to ensure that the gland nut 28 is not stripped by fluid pressures exerted on the high-pressure packing 26, while being radially spaced apart from the outer periphery of the mandrel 14 in order to permit free reciprocation of the mandrel 14 within the axial passage 16 of the adapter spool 12.

An adapter pin 32 has an axial bore 34, and includes a top end that threadedly engages an external spiral thread on the bottom end of the mandrel 14, and a bottom end sized to match a size of a production tubing (not shown) in the well, for example, ⅜", 27/8" or 3½". The adapter pin 32 is equipped with any required thread pattern on the bottom end to match that of a tubing hanger 106 (FIG. 3) from which the tubing is suspended in the well. Typically, the tubing hanger has E.U.E. threads, which are well known in the art. The adapter pin 32 is interchangeable to permit the tool 10 to be connected to different sizes of tubing hangers. Ring seals 36 are incorporated in the adapter pin 32 to provide a seal between the mandrel 14 and the adapter pin 32 to prevent fluid leakage when high-pressure fluid flows through a central passage 38 of the mandrel 14 and the central bore 34 of the adapter pin 32.

The mandrel 14 further includes a stud pad 40 having threaded bores 42 for receiving studs for mounting a high-pressure valve 64 (FIG. 2) thereon. A bottom flange 44 of the adapter spool 12 includes mounting bores 46 for bolting the adapter spool 12 to a top of another spool, such as a blowout preventer or a tubing head spool. An annular groove 48 is also provided in the bottom flange 44 of the adapter spool 12 and the stud pad 40 of the mandrel 14 respectively, for receiving a gasket seal (not shown) when the tool 10 is connected between a high-pressure valve and one of the tubing head spool and a blowout preventer mounted to the tubing head spool.

The reciprocation of the mandrel 14 within the axial passage 16 of the adapter spool 12 is limited in a downward direction by the stud pad 40 and in an upward direction by the adapter pin 32, which has a diameter greater than that of the throat region 20, and smaller than that of the docking region 22 of the adapter spool 12. Thus, the mandrel 14 can reciprocate within the adapter spool 12 but cannot be removed from the adapter spool 12 when the adapter pin 32 is connected to the mandrel 14.

The adapter spool 12 further includes a bleed-off port 50 which is closed by a needle valve 52, having a pressure rating of at least 10,000 Psi. The needle valve 52 is left open during well stimulation treatment so that any pressure leak is readily detected.

When the lockdown nut 30 is connected to a service rig or boom truck (neither one shown) and the well stimulation tool 10 is hoisted above one of a tubing head spool and a blowout preventer mounted on the tubing head spool, the mandrel 14 moves downward under its own weight and the adapter pin 32 extends beneath the bottom flange 44 of the adapter spool 12. Thus, the adapter pin 32 can be visually guided into a connection with the tubing hanger in the tubing head spool, or inserted through the blowout preventer mounted on the tubing head spool to be connected to the tubing hanger in the tubing head spool. After the adapter pin 32 is connected to the tubing hanger, the adapter spool 12 is lowered to permit it to be mounted to the top of the tubing head spool, or the top of the blowout preventer. This operation will be further described below with reference to FIGS. 2 and 3.

Figure 2:
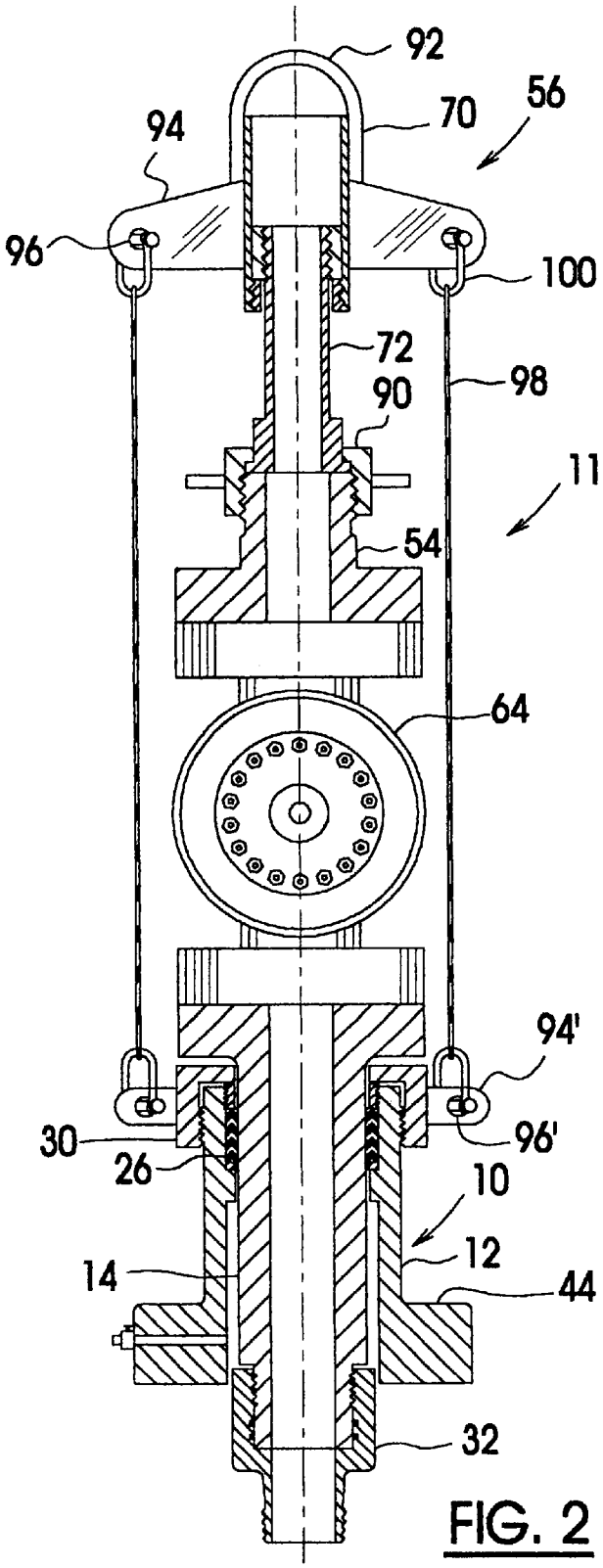
FIG. 2 is a cross-sectional view of a well stimulation tool connected to a high-pressure valve and in a suspended position for installation on the well, in accordance with another embodiment of the invention.

FIGS. 2 and 3 illustrate another embodiment of the invention, generally indicated by numeral 11 which includes the well stimulation tool 10 illustrated in FIG. 1, and further includes a high-pressure flange 54 and a lifting head assembly 56.

Figure 4:
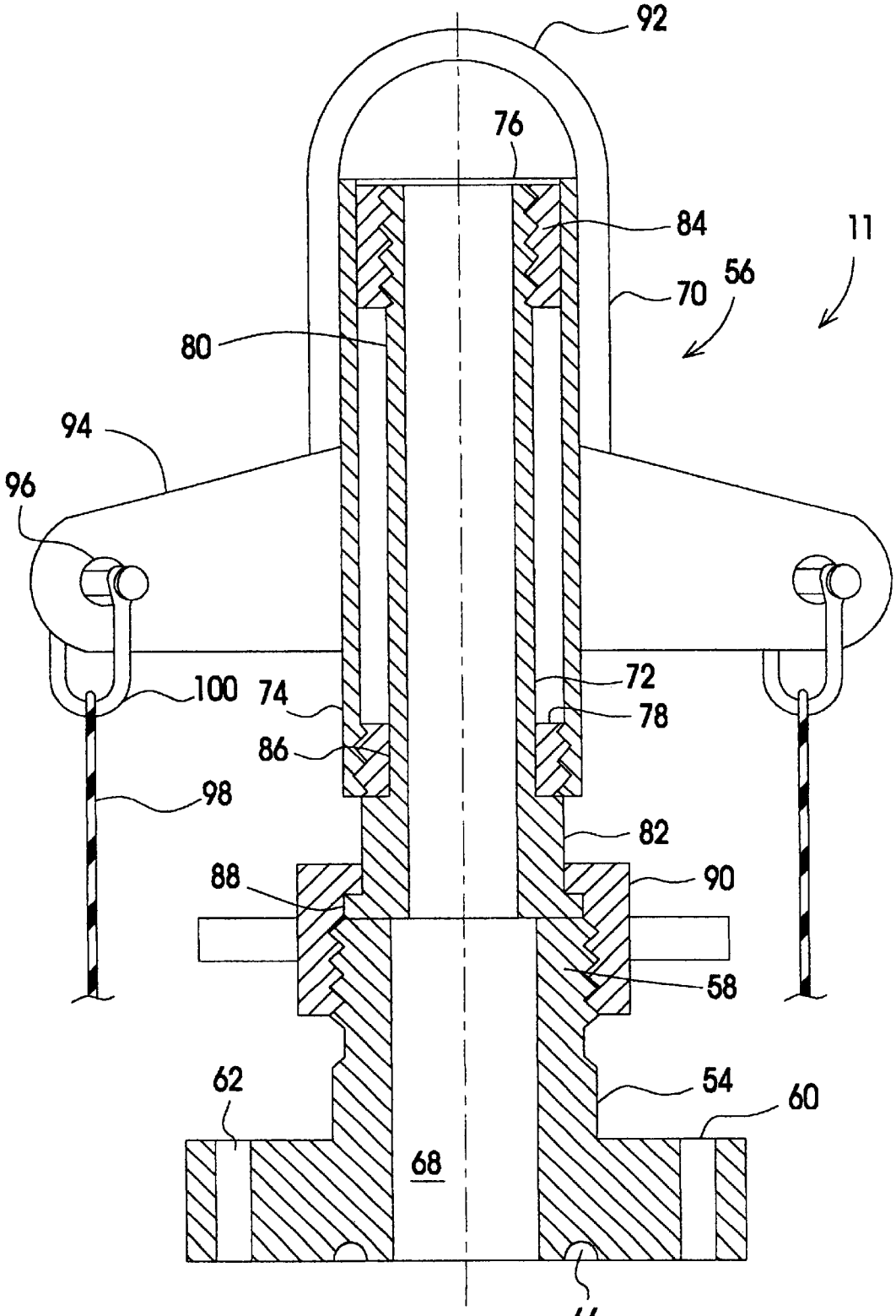
FIG. 4 is a detailed cross-sectional view of a lifting head assembly and a high-pressure flange used with the well stimulation tool shown in FIGS. 2 and 3.

The high-pressure flange 54 and the lifting head assembly 56 are illustrated in detail in FIG. 4. The high-pressure flange 54 includes a pressure flange top end 58 having a spiral thread on an outer periphery thereof for connection of the lifting head assembly 56, a wireline lubricator, or a high-pressure fluid line, as will be further described below with reference to FIGS. 5–7. The high-pressure flange 54 also includes a bottom flange 60 with mounting bores 62 that extend therethrough for bolting the high-pressure flange 54 to a top of the high-pressure valve 64, as shown in FIGS. 2 and 3. An annular groove 66 is provided in the bottom flange 60 for receiving a gasket seal (not shown) when the high-pressure flange 54 is mounted to the high-pressure valve 64 shown in FIGS. 2 and 3. An axial passage 68 extends through the high-pressure flange 60 for fluid communication with the high-pressure valve 64.

The lifting head assembly 56 includes a lifting head 70 and a lifting sub 72. The lifting head 70 includes a hollow cylinder 74, which has a top end 76 and a bottom wall 78 that is preferably threadedly secured to a bottom end thereof. The lifting sub 72 has a side wall 80, interconnecting a lifting sub bottom end 82 and a lifting sub top end 84. The lifting sub top end 84 has a diameter slightly smaller than an inner diameter of the cylinder 74, and greater than an outer diameter of the side wall 80 so that the lifting sub top end 84 is slidingly guided within the cylinder 74 when the side wall 80 of the lifting sub 72 reciprocates through an axial aperture 86 in the bottom wall 78 of the cylinder 74. The lifting sub top end 84 is preferably threadedly connected to the top end of the side wall 80. The lifting sub bottom end 82 has a diameter greater than that of the aperture 86 of the bottom wall 78, so that the aperture 86 of the bottom wall 78 permits free reciprocation of the lifting sub 72 within the cylinder 74, but prevents the lifting sub 72 from being removed in either direction from the cylinder 74. The lifting sub bottom end 82 further includes a bottom shoulder 88 that rotatably engages a hammer union 90, which threadedly engages the spiral thread on the outer periphery of the top end 58 of the high-pressure flange 54.

The lifting head 70 further includes a lifting eye 92, which is used to manipulate the well stimulation tool 11. The lifting eye 92 is affixed to the top end of the cylinder 74. The lifting head 70 is provided with a mechanism for connecting the adapter spool 12 shown in FIGS. 2 and 3 which, in this embodiment, includes two opposed radially extending lift arms 94 adjacent to the bottom end of the lifting head 70. Each of the lift arms 94 includes a lift eye 96 located near an outer end thereof. The lockdown nut 30 shown in FIGS. 2 and 3 also includes two opposed radially extending lift arms 94', with lift eyes 96' in their respective outer ends. Corresponding lift arms 94 and 94' on the respective lift head 70 and the lockdown nut 30 are interconnected by lifting cables 98 using removable connectors, such as a clevis 100 that is well known in the art.

A typical well is completed for stimulation by running a production tubing into the well. The production tubing is generally run into the well through a blowout preventer mounted to the top of the tubing head spool. After the production tubing is run into the well, a tubing hanger is connected to a top of the production tubing, and the tubing hanger is inserted through the blowout preventer and into tubing head spool where it is secured in a manner well known in the art. In well completion or well workover, which require a well stimulation procedure, the well stimulation tool 10 or 11 in accordance with the invention, can be used to direct high-pressure stimulation fluids into the well through the production tubing. A method of using the well stimulation tool 10 or 11 is described below.

The stimulation of a hydrocarbon well from which a blowout preventer has been removed is illustrated in FIGS. 2, 3, 5 and 6. As an example, the well stimulation tool. 11 is used to illustrate the features and advantages of the present invention. A boom truck or a rig (not shown) is used to hoist the combination of the well stimulation tool 11 and the high-pressure valve 64 by connecting the hoist (not shown) to the lifting eye 92 at the top of the lifting head 70. When the combination of the well stimulation tool 11 and the high-pressure valve 64 is lifted using the lifting eye 92, the lifting cables 98 support the weight of the lockdown nut 30 and the adapter spool 12. Consequently, the weight of the high-pressure valve 64, the mandrel 14, the high-pressure flange 54 and the lifting sub 72 causes the mandrel 14 to stroke down through the packing 26 in the adapter spool 12 and the lifting sub 72 to stroke down through aperture 86 in the lifting head 70, so that the adapter pin 32 extends beneath the bottom flange 44 of the adapter spool 12 to an extent, as shown in FIG. 2, which facilitates the connection of the adapter pin 32 to a tubing hanger 106 in the tubing head spool 12 shown in FIG. 3.

The combination of the well stimulation tool 11 and the high-pressure valve 64 illustrated in FIG. 2 is suspended over a wellhead to which a tubing head spool 102 (see FIG. 3) is mounted. A production tubing 104 is suspended from the tubing hanger 106, which is secured in the tubing head spool 102. The combination of the well stimulation tool 11 and the high-pressure valve 64 is lowered and rotated to threadedly engage the bottom end of the adapter pin 32 with the top end of the tubing hanger 106 shown in FIG. 3. It should be understood that the adapter pin 32 is visible to permit it to be visually guided into a connection with the tubing hanger 106. This facilitates the connection and helps to ensure that the threads on the adapter pin are not damaged. After the adapter pin 32 is securely connected to the tubing hanger 106, the boom truck or rig is operated to further lower the combination of the well stimulation tool 11 and the high-pressure valve 64, which causes the adapter spool 12, the lockdown nut 30 and the lifting head 70 to move downwardly until the adapter spool 12 rests on the top of the tubing head spool 102 when the high-pressure valve 64 with the remaining parts of the well stimulation tool 11 are supported by the tubing hanger 106, as illustrated in FIG. 3. The bottom flange 44 of the adapter spool 12 and the top flange of the tubing head spool 102 are then bolted together and the installation of the well stimulation tool 11 with the high-pressure valve 64 is thereby completed.

Figure 5:
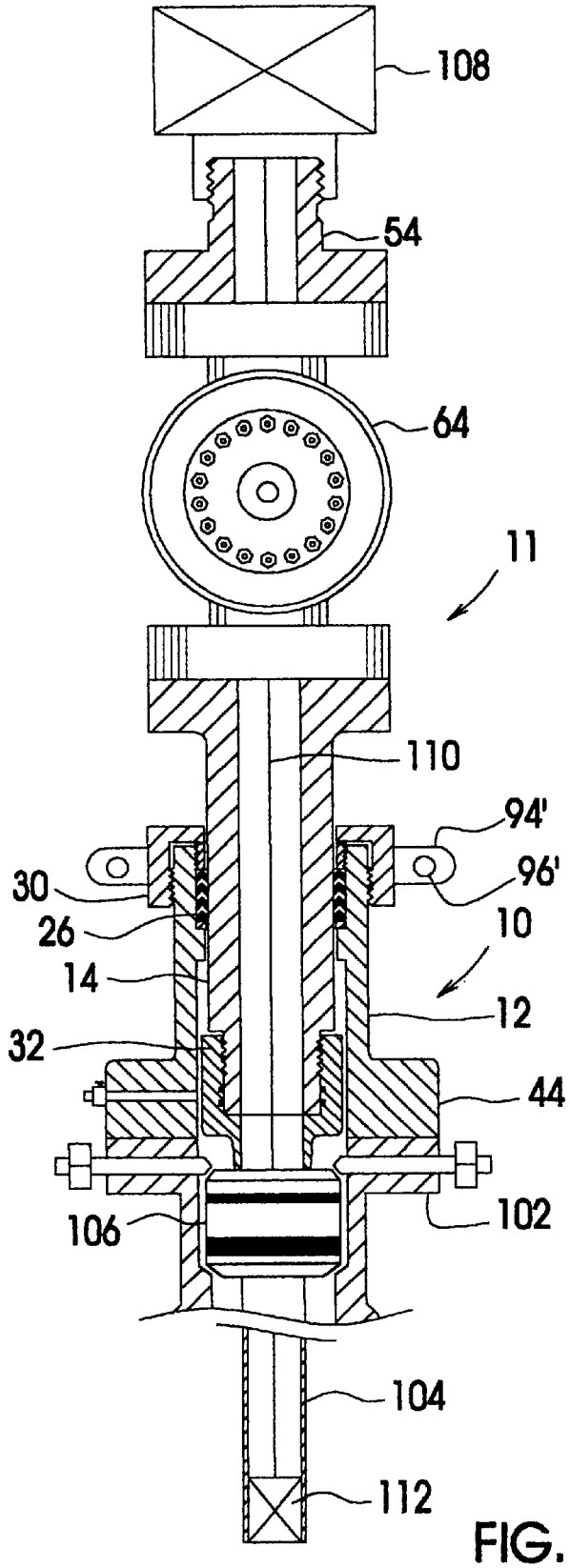
FIG. 5 is a schematic cross-sectional view of the well stimulation tool shown in FIGS. 2 and 3 with a lubricator that is being used to retrieve a plug from a production tubing so that the well stimulation tool can be used to stimulate a hydrocarbon well, without a blowout preventer.

Subsequently, the respective clevises 100 that connect the lifting cables 98 to the lockdown nut 30 are released. The hammer union 90 is also released. Thus, the lifting head assembly 56 with the hammer union 90 can be removed from the top end of the high-pressure flange 54. As illustrated in FIG. 5, a lubricator that is well known in the art, typically a wireline lubricator 108 (which is schematically illustrated), is then connected to the top end of the high-pressure flange 54. After the wireline lubricator 108 is mounted to the top end of the high-pressure flange 54, the high-pressure valve 64 is opened and a wireline 110 is run into the production tubing 104 to retrieve a retrievable plug 112 that is normally set in the production tubing 104 before it is run into the well. The high-pressure valve 64 is then closed and the wireline lubricator 108 is removed.

Figure 6:
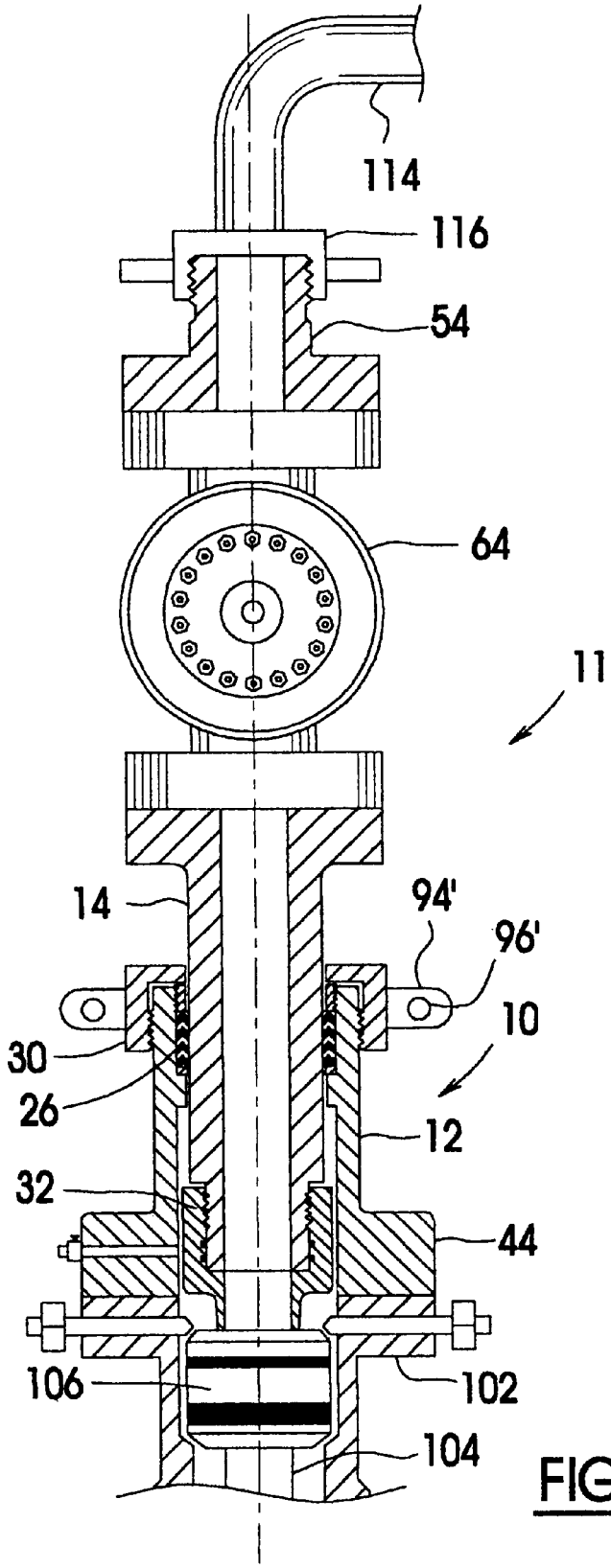
FIG. 6 is a schematic cross-sectional view of the well stimulation tool illustrated in FIG. 5 with the lubricator removed and a high-pressure line connected to the well stimulation tool.

Thereafter, a high-pressure line 114, as illustrated in FIG. 6, is connected to the top end of the high-pressure flange 54 using a hammer union 116 in a manner well known in the art. The high-pressure valve 64 is then opened and high-pressure fluids, such as acidizing or fracturing fluids, are pumped through the high-pressure flange 54, the high-pressure valve 64, the mandrel 14, the adapter pin 32, the tubing hanger 106, the production tubing 104, and into the well.

After the well stimulation procedure is complete, the stimulation fluids are "flowed back" through the well stimulation tool 11 and the high-pressure valve 64. When the flow-back process is complete, the high-pressure valve 64 is closed and the high-pressure line 114 is disconnected from the high-pressure flange 54. If the well contains natural pressure, the tubing must be plugged once again before the well stimulation tool 11 and the high-pressure valve 64 can be removed. Consequently, the wireline lubricator 108 is mounted again to the high-pressure flange 54 as shown in FIG. 5 and the wireline 110 is run down to reset the removable plug 112 in the production tubing 104.

After the plug 112 is set, the wireline 110 is retrieved and then the wireline lubricator 108 is again removed from the high-pressure flange 54.

After the wireline lubricator 108 is removed, the lifting head assembly 56 shown in FIG. 4 is hoisted back to the top end of the high-pressure flange 54. The lifting cables 98 are connected to the respective lifting eyes 96' in the lockdown nut 30 by re-inserting the devises 100, and the lifting sub 72 is connected to the top end of the high-pressure flange 54 using the hammer union 90. The adapter spool 12 is then unbolted from the tubing head spool 102 and a hoist (not shown) is connected to the lifting eye 92 at the top of the lifting head 70. The lifting head 70 is hoisted to expose the adapter pin 32, the bottom end of which is then disconnected from the tubing hanger 106. Thereafter, the entire well stimulation tool 11 together with the high-pressure valve 64 is hoisted onto a service truck (not shown).

After the well stimulation tool 11 with the high-pressure valve 64 is removed, a wellhead (not shown) is mounted to the tubing head spool 102. The wireline lubricator 108 is then mounted to the top of the wellhead and the wireline 110 is run into the production tubing string to retrieve the plug 112. The well is then ready for the production of hydrocarbons.

It should be noted that after the tubing hanger 106 is secured in the tubing head spool 102 in a well completion, a blowout preventer that was required for the well completion procedure may remain on the wellhead. It should be understood, however, that the well stimulation tool 10 or 11 in accordance with the invention can be used with or without a blowout preventer in place.

FIG. 7 illustrates the well stimulation tool 11, which is assembled with the high-pressure valve 64 and is mounted on the top of a blowout preventer 120. The blowout preventer 120 is mounted on the top of the tubing head spool 102. In this case, either the adapter pin 32 or the mandrel 14 must be longer than that of a similar well stimulation tool 11 used for a wellhead from which a blowout preventer is removed, such as the embodiment illustrated in FIGS. 2, 3, 5 and 6. In the embodiment illustrated in FIG. 7, a longer adapter pin 32' replaces the adapter pin 32 shown in FIGS. 2, 3, 5 and 6. The use of the well stimulation tool 11 to stimulate a hydrocarbon well to which a blowout preventer 120 shown in FIG. 7 is mounted is similar to the procedure described with reference to FIGS. 2, 3, 5 and 6, and is therefore not redundantly described.

As will be understood by those skilled in the art, the well stimulation tool 10 in accordance with the invention can be used without the lifting head assembly. In that case, the adapter spool 12, the mandrel 14 and the adapter pin 32 are mounted to a top of the tubing head spool 102 shown in FIG. 6, as described above. After they are installed, a high-pressure valve 64 shown in FIG. 6 is mounted to the top flange of the mandrel 14 and a high-pressure line 114 shown in FIG. 6 is connected to a top of the high-pressure valve 64. The high-pressure flange 54 described above may also be used to connect the high-pressure line to the high-pressure valve. It should be further understood that the lockdown nut 30 shown in FIG. 1 may include lift arms 94' (FIG. 2) with lift eyes 96' to which cables are connected for hoisting the well stimulation tool 10 into position over the wellhead, or removing the well stimulation tool from the wellhead.

The embodiments of the invention described above are therefore intended to be exemplary only. Consequently, the scope of the invention is intended to be limited only by the scope of the appended claims.

I claim:

1. A well stimulation tool for stimulating a well having a tubing head spool and a production tubing suspended from a tubing hanger in the tubing head spool, comprising:

an adapter spool having a bottom flange adapted for connection to one of the tubing head spool and a blowout preventer mounted to the tubing head spool, and a top end adapted to receive a mandrel that can be reciprocally moved through packing that surrounds the mandrel and is retained in a packing cavity in the top end, the top end further including threads for securing a lockdown nut that covers the packing and surrounds an outer periphery of the mandrel;

the mandrel having a mandrel top end and a mandrel bottom end, the mandrel top end having a flange adapted for the connection of a high-pressure valve, and the mandrel bottom end having a thread for the connection of an adapter pin; and the adapter pin having an adapter pin top end and an adapter pin bottom end, the adapter pin top end having threads for connecting the adapter pin to the mandrel, and the adapter pin bottom end having threads for connecting the adapter pin to a top end of the tubing hanger.

2. A well stimulation tool as claimed in claim 1, further comprising:

a high-pressure flange adapted to be mounted to a top of the high-pressure valve, the high-pressure flange having a pressure flange top end and a bottom flange, the bottom flange being adapted for connection to a top flange of the high-pressure valve and the pressure flange top end being threaded for connection of a high-pressure line for injecting high-pressure well stimulation fluids into the well.

3. A well stimulation tool as claimed in claim 1, further comprising a lifting head assembly having a first member that includes a bottom end adapted to be connected to the high-pressure flange, and a second member having means for connecting the lift head to a hoist, in order to permit the well stimulation tool to be lifted for installation on, or removal from, the one of the tubing head and the blowout preventer.

4. A well stimulation tool as claimed in claim 3, wherein the first member comprises a lifting sub having a lifting sub top end, a lifting sub bottom end and a cylindrical side wall that interconnects the lifting sub top end and the lifting sub bottom end, and the second member comprises a lifting head comprising a hollow cylinder having a lifting head top end and a lifting head bottom end, the lifting head bottom end including an aperture; and the lifting sub top end is received in the hollow cylinder and freely reciprocates therein, but cannot pass through the aperture in the lifting head bottom end, and the lifting sub bottom end is adapted to be connected to the pressure flange top end.

5. A well stimulation tool as claimed in claim 4, wherein the lifting head assembly further comprises a lifting eye affixed to the lifting head top end.

6. A well stimulation tool as claimed in claim 4, wherein the lifting head further comprises opposed, radially extending lift arms adjacent the lifting head bottom end, the lift arms, each including a lift eye located near an outer end thereof.

7. A well stimulation tool as claimed in claim 6, wherein the lockdown nut further comprises opposed, radially extending lift arms, each including a lift eye located near an outer end thereof.

8. A well stimulation tool as claimed in claim 7, further comprising:

first and second lifting cables, the first lifting cable having opposed ends respectively connected to a corresponding lift eye in one of the lift arms of the lifting head and a lift eye in one of the lift arms of the lockdown nut, and the second lifting cable having opposed ends respectively connected to a corresponding lift eye in the other of the lift arms of the lifting head and a lift eye in the other of the lift arms of the lockdown nut;

whereby when the well stimulation tool is lifted using the lifting eye affixed to the lifting head top end, the lifting sub top end moves downwardly within the hollow cylinder and the lifting cables bear the weight of the lockdown nut and the adapter spool, so that the mandrel is stroked down through the adapter spool and the adapter pin is extended beneath the bottom flange of the adapter spool to permit the adapter pin to be connected to, or disconnected from, the top end of the tubing hanger.

9. A well stimulation tool as claimed in claim 1, wherein the adapter spool further comprises a pressure bleed port.

10. A well stimulation tool as claimed in claim 9, wherein the pressure bleed port is closed by a high-pressure needle valve.

11. A method of stimulating a hydrocarbon well comprising steps of:

connecting a well stimulation tool to a top of a tubing hanger in a tubing head spool of the well, the well stimulation tool comprising:

an adapter spool having a bottom flange adapted for connection to the tubing head spool, and a top end adapted to receive a mandrel that can be reciprocally moved through packing that surrounds the mandrel and is retained in a packing cavity in the top end, the top end further including threads for securing a lockdown nut that covers the packing and surrounds an outer periphery of the mandrel;

the mandrel having a mandrel top end and a mandrel bottom end, the mandrel top end having a flange adapted for the connection of a high-pressure valve, and the mandrel bottom end having a thread for the connection of an adapter pin; and the adapter pin having an adapter pin top end and an adapter pin bottom end, the adapter pin top end having threads for connecting the adapter pin to the mandrel, and the adapter pin bottom end having threads for connecting the adapter pin to a top of the tubing hanger;

mounting a high-pressure valve to the flange at the mandrel top end;

connecting a high-pressure line to a top of the high-pressure valve;

opening the high-pressure valve; and pumping high-pressure fluid through the high-pressure line to stimulate the hydrocarbon well.

12. A method as claimed in claim 11 wherein, after the step of mounting the high-pressure valve to the flange and before connecting the high-pressure line, the method further comprises steps of:

mounting a wireline lubricator to a top of the high-pressure valve;

opening the high-pressure valve running in a wireline and retrieving a plug from a production tubing suspended from the tubing hanger;

closing the high-pressure valve; and removing the wireline lubricator.

13. The method as claimed in claim 12, further comprising steps of:

closing the high-pressure valve;

disconnecting the high-pressure line; mounting the wireline lubricator to the top of the high-pressure valve;

running in the wireline to reset the plug in the production tubing;

retrieving the wireline;

removing the wireline lubricator; and removing the well stimulation tool and the high-pressure valve from the tubing head spool.

14. The method as claimed in claim 13, further comprising steps of:

mounting a wellhead to the tubing head spool;

mounting the wireline lubricator to the wellhead; and running in the wireline to retrieve the plug.

15. A method of stimulating a hydrocarbon well comprising steps of:

assembling a combination of a well stimulation tool and a high-pressure valve, the well stimulation tool comprising:

an adapter spool having a bottom flange adapted for connection to a tubing head spool, and a top end adapted to receive a mandrel that can be reciprocally moved through packing that surrounds the mandrel and is retained in a packing cavity in the top end, the top end further including threads for securing a lockdown nut that covers the packing and surrounds an outer periphery of the mandrel;

the mandrel having a mandrel top end and a mandrel bottom end, the mandrel top end having a flange adapted for the connection of the high-pressure valve, and the mandrel bottom end having a thread for the connection of an adapter pin;

the adapter pin having an adapter pin top end and an adapter pin bottom end, the adapter pin top end having threads for connecting the adapter pin to the mandrel, and the adapter pin bottom end having threads for connecting the adapter pin to a top of a tubing hanger in the tubing head spool; and a lifting head assembly including a bottom end for connection of the high-pressure valve and a top end with a lifting eye to permit the well stimulation tool to be lifted for mounting to the tubing head spool;

hoisting the combination of the well stimulation tool and the high-pressure valve above the tubing head spool of the well by connecting to the lifting eye;

lowering the combination to connect the adapter pin bottom end to the tubing hanger and further lowering the combination to mount the adapter spool to the tubing head spool; and connecting a high-pressure line to the high-pressure valve to permit high-pressure fluids to be pumped into the hydrocarbon well.

16. The method as claimed in claim 15, wherein prior to connecting the high-pressure line, the method further comprises steps of:

disconnecting the lifting head assembly from the high-pressure valve and the adapter spool after the adapter pin is connected to the tubing hanger and the adapter spool is mounted to the tubing head spool; and removing the lifting head assembly from the high-pressure valve.

17. The method as claimed in claim 16, further comprising steps of:

mounting a wireline lubricator to a top of the high-pressure valve;

opening the high-pressure valve;

running in a wireline and retrieving a plug from the production tubing;

closing the high-pressure valve; and removing the wireline lubricator.

18. The method as claimed in claim 17, further comprising steps of:

closing the high-pressure valve;

disconnecting the high-pressure line;

mounting the wireline lubricator to the top of the high-pressure valve;

opening the high-pressure valve;

running in the wireline to reset the plug in the production tubing;

retrieving the wireline;

removing the wireline lubricator; and removing the combination of the well stimulation tool and the high-pressure valve from the tubing head spool.

19. The method as claimed in claim 18, further comprising steps of:

mounting a wellhead to the tubing head spool;

mounting the wireline lubricator to the wellhead; and running in the wireline to retrieve the plug.

20. The method as claimed in claim 18, wherein the removal of the combination of the well stimulation tool and the high-pressure valve comprises steps of:

hoisting the lifting head assembly back on the high-pressure valve;

connecting the first member of the lifting head assembly to the high-pressure valve and connecting the second member of the lifting head assembly to the adapter spool;

disconnecting the adapter spool from the tubing head spool;

lifting the lifting head assembly to expose the adapter pin;

disconnecting the adapter pin bottom end from the tubing hanger; and removing the combination of the well stimulation tool and the high-pressure valve.

* * * * *

UNITED STATES PATENT AND TRADEMARK OFFICE

CERTIFICATE OF CORRECTION

PATENT NO. : 6,769,489 B2
DATED : August 3, 2004
INVENTOR(S) : L. Murray Dallas

It is certified that error appears in the above-identified patent and that said Letters Patent is hereby corrected as shown below:

Column 1,
Line 8, please correct the filing date to read -- November 28, 2001 --.

Column 3,
Line 66, please delete the numbers "3/8", 27/8"" and replace with -- 2 $^{3}/_{8}$", 2 $^{7}/_{8}$" --.

Signed and Sealed this

First Day of November, 2005

JON W. DUDAS
*Director of the United States Patent and Trademark Office*